US006174187B1

(12) United States Patent
Yamagami et al.

(10) Patent No.: US 6,174,187 B1
(45) Date of Patent: Jan. 16, 2001

(54) ELECTRICAL CONNECTOR

(75) Inventors: Yoku Yamagami; Hirokatsu Yaegashi; Tsuyoshi Sakata; Tsutomu Mtsuo, all of Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/845,433

(22) Filed: Apr. 25, 1997

(30) Foreign Application Priority Data

Apr. 26, 1996 (JP) ..... 8-106664

(51) Int. Cl.[7] ..... H01R 13/62
(52) U.S. Cl. ..... 439/326; 439/630
(58) Field of Search ..... 439/326–328, 439/629–637, 59–62

(56) References Cited

U.S. PATENT DOCUMENTS 5,061,201 * 10/1991 Tuan ..... 439/326
5,080,602 * 1/1992 Lee Chao ..... 439/326
5,116,237 * 5/1992 Loewen ..... 439/326
5,161,994 * 11/1992 Sato et al. ..... 439/326
5,480,316 * 1/1996 Kinross et al. ..... 439/326
5,695,353 * 12/1997 Sakata et al. ..... 439/326

* cited by examiner

*Primary Examiner*—Hien Vu
(74) *Attorney, Agent, or Firm*—Kanesaka & Takeuchi

(57) ABSTRACT

An electrical connector for connecting to a mother board a daughter board having a plurality of pads on a front edge thereof includes a plurality of contact terminals made by stamping and bending a resilient conductive sheet so as to provide first retaining sections which are fixed to the insulating housing. The daughter board is inserted between upper and lower contact portions of the contact terminals with a zero-insertion force and then rotated to bring the pads into contact with the contact portions with a predetermined contact force, with the spring sections flexed so as to reduce the distance between the upper and lower contact portions and made floating.

3 Claims, 13 Drawing Sheets

ELECTRICAL CONNECTOR

BACKGROUND OF THE INVENTION

1. Field the Invention

The present invention relates to electrical connectors for connecting to a mother board a daughter board having a plurality of pads on a front edge thereof in a direction perpendicular, oblique, or parallel to the mother board.

2. Description of the Related Art

Recently, an increasing number of memory modules are used and there is a demand for an electrical connector for allowing high-density mounting. A conventional direct insertion type connector fails to meet the high-density mounting requirement and a variety of rotary type, zero-insertion-force connectors are used.

Japanese patent application Kokai Nos. 230378/85 and 193473/88 disclose such zero-insertion-force connectors. Contact terminals for the electrical connectors are made by stamping a metal sheet having a predetermined thickness. These contact terminals have a very high spring constant because they are stamped from flat work. Consequently, if the spring constant is set to provide a satisfactory contact power for PC boards of the minimum thickness, an excessive force is applied to PC boards of the maximum thickness, causing breakage or difficulty to plug. In addition, the contact terminals are made by stamping so that a considerable amount of rare metal material is wasted. Moreover, the contact terminals made by stamping have contact sections cut by the stamping so that the contact sections must be plated after stamping, resulting in the increased manufacturing costs.

Japanese patent application Kokai No. 78168/90 discloses contact terminals made by stamping and bending a metal sheet instead of those made by stamping alone. By stamping and bending it is possible to avoid the above problems with those made by stamping alone.

However, such an electrical connector has the following disadvantages. That is, since a daughter board is inserted and then rotated, the moment of rotations (in a direction to release the daughter board) warps the daughter board, or the positions of contact points of contact terminals vary with variations in the manufacturing precision, making uneven the contact power of the contact terminals. The warp of a daughter board makes different the contact power in upper and lower contact points and unstable the contact resistance.

Such disadvantages will be described in more detail with reference to FIGS. 13 and 14. As FIG. 13 shows, an electrical connector of this type is mounted on a mother board 10 to connect a daughter board 30 such as a printed circuit board on which memory modules are mounted. The electrical connector 20 has an insulation housing 21 with an elongated opening 25 therein and a pair of latch levers 22 extending upwardly from opposite ends of the elongated opening 25 and having latch sections 23 at the upper portions thereof. A plurality of contact terminals are arranged in the insulation housing 21 along the elongated opening 25. To connect the daughter board 30 to the electrical connector 20 on the mother board 10, the daughter board 20 is inserted obliquely into the elongated opening 25 and rotated rearwardly. When the side edges of the daughter board contact the front faces of the latch sections 23, the daughter board 30 flexes the latch levers 22 outwardly and passes the latch sections 23. When the daughter board passes the latch sections 23, the latch levers snap to the original position to hold the daughter board 30 with the rear faces of the latch sections 23. This completes connection of the daughter board 30 to the electrical connector 20. FIG. 13 shows such connection conditions of the daughter board 30 to the electrical connector 20.

Under such connection conditions as shown in FIG. 13, the daughter board 30 is biased to rotate forwardly by the contact terminals while the upper opposite side edges of the daughter board 30 are held by the latch sections 23 of the latch levers 22 to prevent the forward rotation. Consequently, the higher the moment of forward rotations applied to the daughter board 30 by the contact terminals, the larger the warp of the daughter board 30 as shown with an arrow W in FIG. 13. As FIG. 14 shows, the contact power of the rear contact terminals provided in the middle of the elongated opening 25 is decreased while the contact power of the front contact terminal provided at opposite ends of the elongated opening 25 is decreased, failing to provide stable two-point contacts.

The propositions made to solve such problems include reduction of the contact power of the contact terminals to thereby reduce the moment of rotations, minimizing the warp of a daughter board; holding projections molded with the insulation housing to correct the warped daughter board; and contact terminals made by drawing as shown in Japanese UM patent application Kokoku No. 9347/95.

However, the reduction of the contact power increases the contact resistance, reducing the contact reliability; the molded holding projections fails to meet the tolerance in thickness of daughter boards; and the drawn contact terminals have their own disadvantages.

SUMMARY OF THE INVENTION

Accordingly, it is an object of the invention to provide an economical electrical connector able to maintain the contact power and withstand the moment of rotations under connection conditions.

It is another object of the invention to provide an electrical connector able to maintain a certain level of contact power regardless of degrees of warp of the daughter board warp.

According to one aspect of the invention there is provided an electrical connector for connecting to a mother board a daughter board having a plurality of pads on a front edge thereof, which includes an insulating housing to be mounted on the mother board having front, bottom, and rear walls to define an opening into which the daughter board is inserted at an angle with the mother board and then rotated rearwardly to a connection position; a plurality of terminal receiving grooves provided in the front, bottom, and rear walls of the opening; a plurality of contact terminals provided in the terminal receiving grooves and made by stamping and bending a resilient conductive sheet so as to provide first retaining sections fixed in the terminal receiving grooves in either the front or rear walls, connection sections extending from the first retaining sections and electrically connected to conductors of the mother board, reverse U-shaped sections extending upwardly from the first retaining sections and then to inside of the opening to provide upper or lower contact portions, U-shaped sections extending from the reverse U-shaped sections toward either the front or rear wall and then upward along either the front or rear wall; and free end sections extending from the U-shaped sections toward inside of the opening to provide lower or upper contact portions; the reverse U-shaped, U-shaped, and free end sections constituting spring sections flexed at the first retaining sections; the upper and lower contact portions of the contact terminals being spaced at a distance equal to or slightly greater than a thickness of the front edge of the daughter board and brought into contact with the pads on the front edge with a predetermined contact force by rotating the daughter board rearwardly to flex the spring sections, with the spring sections being flexed at the first retaining sections so as to reduce a distance between the upper and lower contact portions in a direction of depth of the opening.

According to another aspect of the invention there is provided an electrical connector for connecting to a mother board a daughter board having a plurality of pads on a front edge thereof, which includes an insulating housing to be mounted on the mother board having front, bottom, and rear walls to define an opening into which the daughter board is inserted at an angle with the mother board and then rotated rearwardly to a connection position; a plurality of terminal receiving grooves provided in the front, bottom, and rear walls of the opening; a plurality of contact terminals provided in the terminal receiving grooves and made by stamping and bending a resilient conductive sheet so as to provide first retaining sections fixed in the terminal receiving grooves in either the front or rear walls, connection sections extending from the first retaining sections and electrically connected to conductors of the mother board, reverse U-shaped sections extending upwardly from the first retaining sections and then to inside of the opening to provide upper or lower contact portions, U-shaped sections extending from the reverse U-shaped sections toward either the front or rear wall and then upward along either the front or rear wall; and free end sections extending from the U-shaped sections toward inside of the opening to provide lower or upper contact portions; the reverse U-shaped, U-shaped, and free end sections constituting spring sections flexed at the first retaining sections; the upper and lower contact portions of the contact terminals being spaced at a distance equal to or slightly greater than a thickness of the front edge of the daughter board, and the spring sections being flexed at the first retaining sections so as to bring the upper or lower contact portions into contact with the pads on the front edge with a predetermined contact force and to float toward the front or rear wall when the daughter board is rotated rearwardly.

According to an embodiment of the invention, the upper and lower contact portions of the contact terminals contact the pads on the front edge when the daughter board is rotated rearwardly to the connection position.

According to another embodiment of the invention, upper portions of the reverse U-shaped sections from the first retaining sections are made floating columns and the terminal receiving grooves in the front or rear wall facing the floating columns are provided with enlarged spaces.

According to still another embodiment of the invention, the floating columns have a length or width selected to control a spring constant thereof.

According to yet another embodiment of the invention, beads are provided on the floating columns to control deformation of the floating columns.

DESCRIPTION OF THE PREFERRED EMBODIMENT

Figure 1:
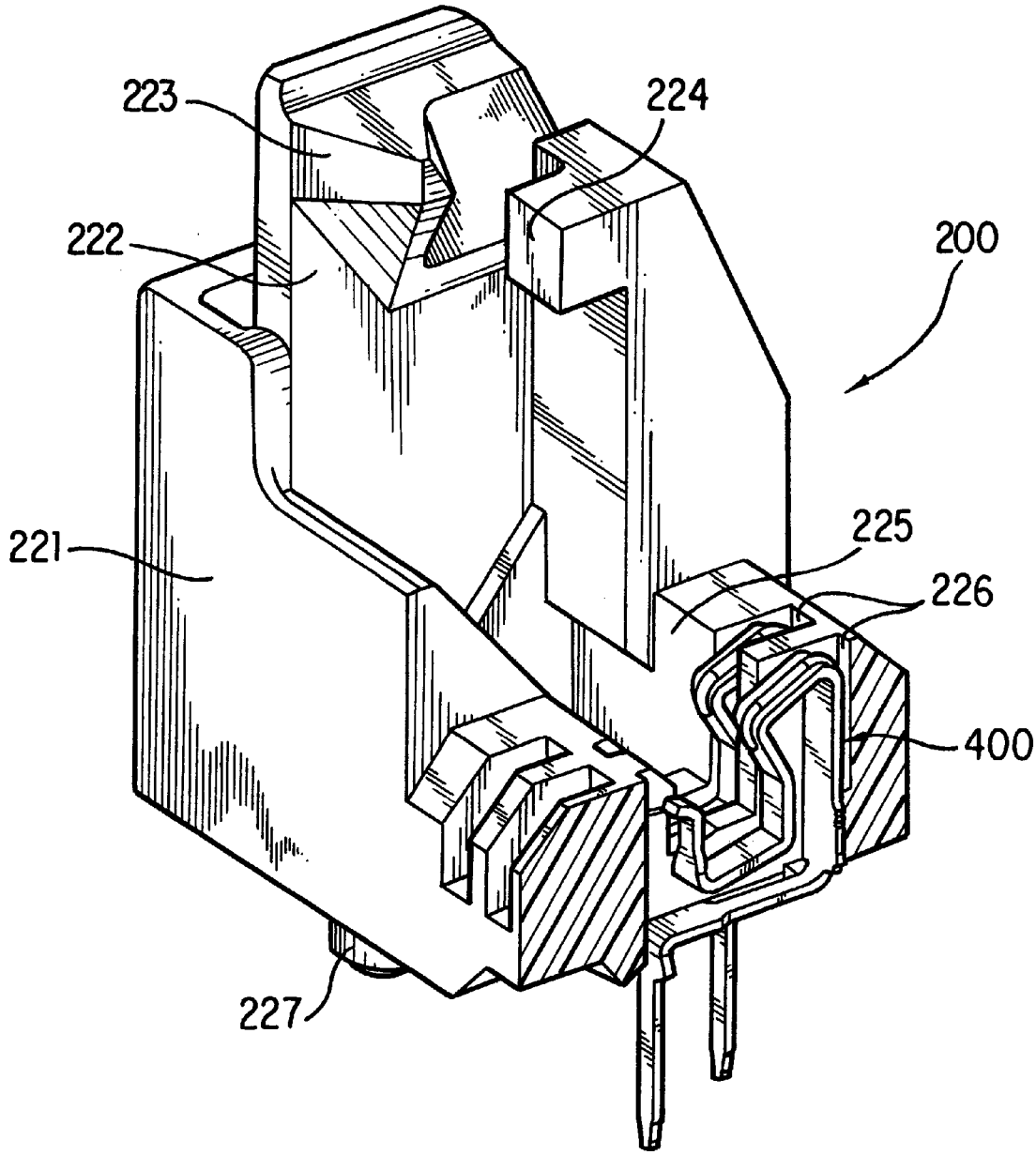
FIG. 1 is a partially cutaway perspective view of an electrical connector according to an embodiment of the invention.

In FIG. 1, an electrical connector 200 includes an insulation housing 221 which is to be mounted on a mother board. An opening 225 extends in the longitudinal. direction of the insulation housing 221. A daughter board or a printed circuit board with memory modules mounted thereon is inserted obliquely into the opening 225 and rotated rearwardly to the vertical connection position.

A plurality of common pads are arranged on a front edge of the daughter board at predetermined intervals. The common pads are connected to terminals of respective components, such as memories, via conductor patters.

A plurality of terminal receiving grooves 226 are provided in each of the front, bottom, and rear walls of the opening 225 at regular intervals equal to those of the common pads. A plurality of contact terminals 400 are placed in the terminal receiving grooves 226.

A pair of latch levers 222 are provided on opposite sides of the opening 225, and latch sections 223 are provided on the upper ends of the latch levers 222. A projection 224 is provided on the rear wall of the insulation housing 221 near the latch lever 222 to prevent the daughter board from coming out of the electrical connector. An engaging hole is provided in the daughter board at the corresponding position. A pair of guide posts 227 extend downwardly from the bottom of the insulation housing 221.

Figure 5:
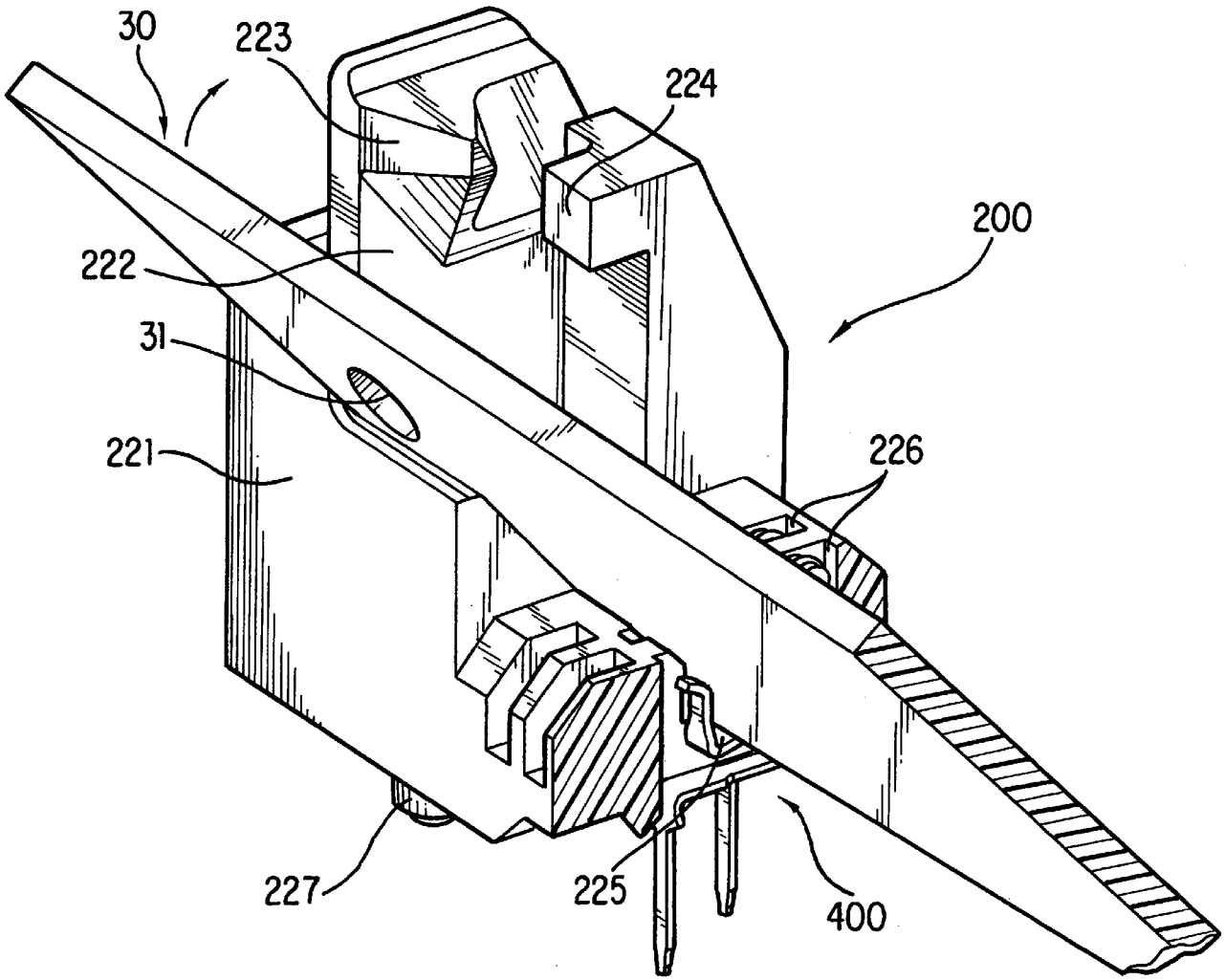
FIG. 5 is a partially cutaway perspective view of the electrical connector of FIG. 1 to which a daughter board is being connected.
Figure 6:
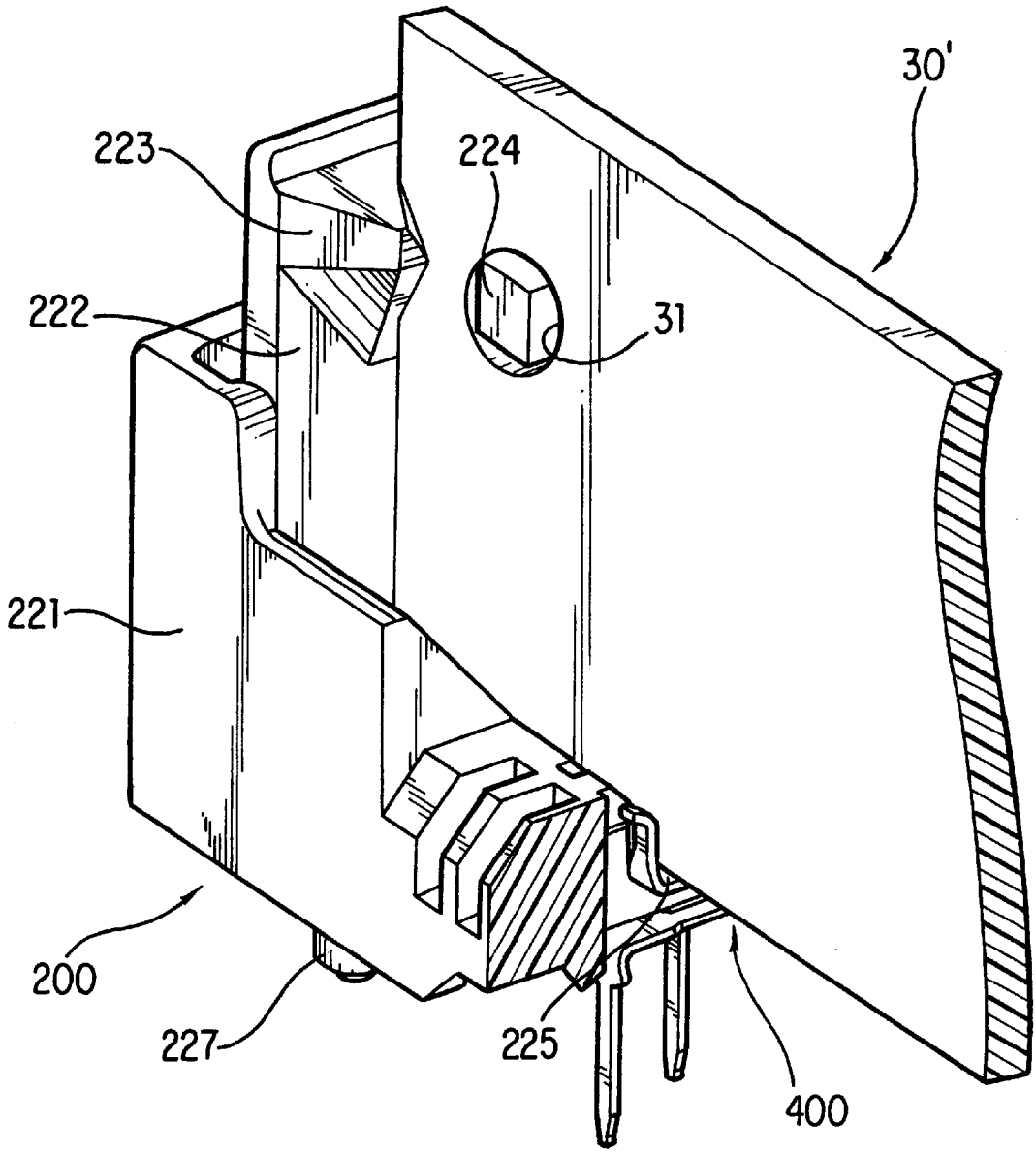
FIG. 6 is a partially cutaway perspective view of the electrical connector of FIG. 1 to which the daughter board has been connected.
Figure 7:
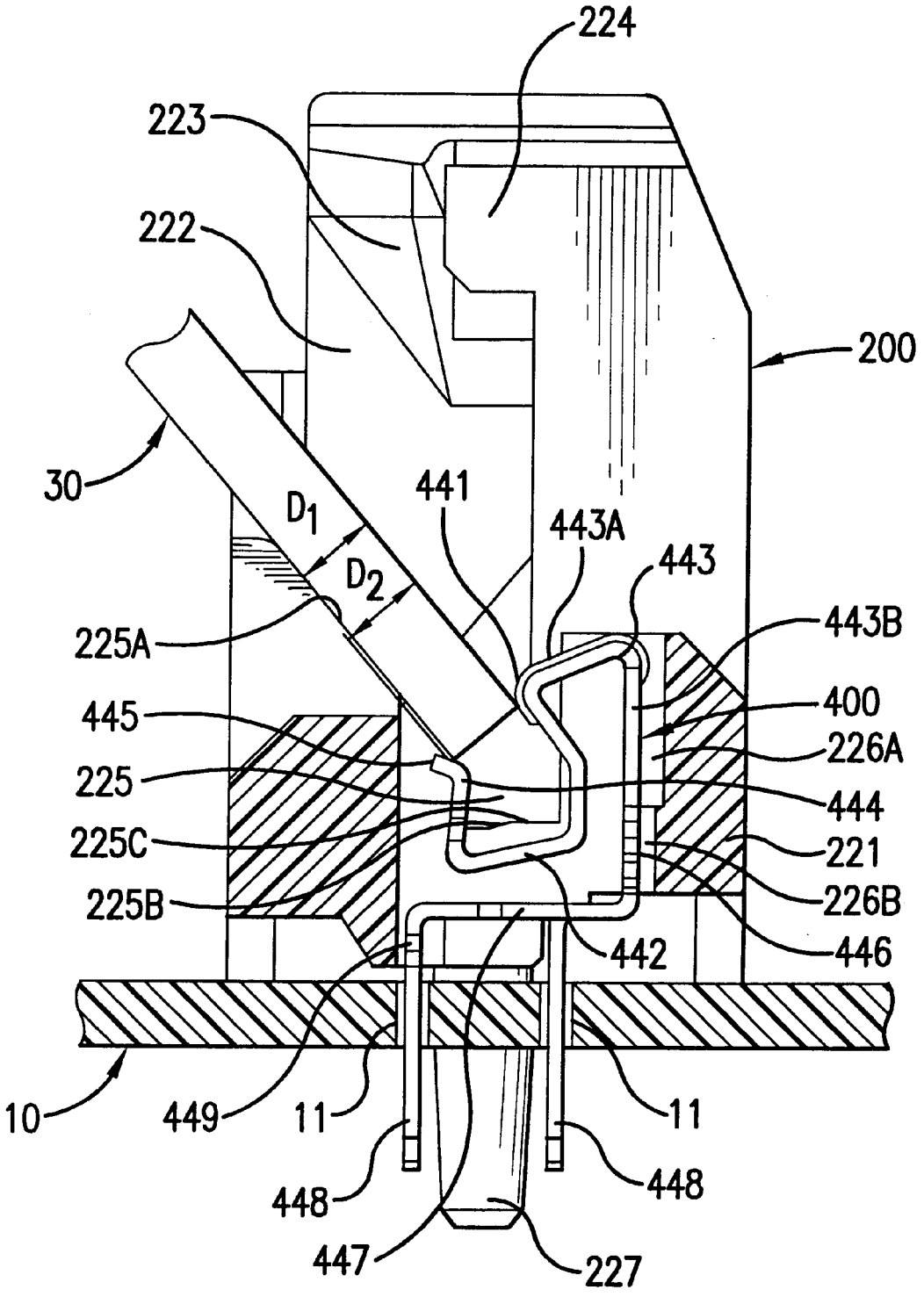
FIG. 7 is a sectional view of the electrical connector of FIG. 1 to which a daughter board is being connected.
Figure 8:
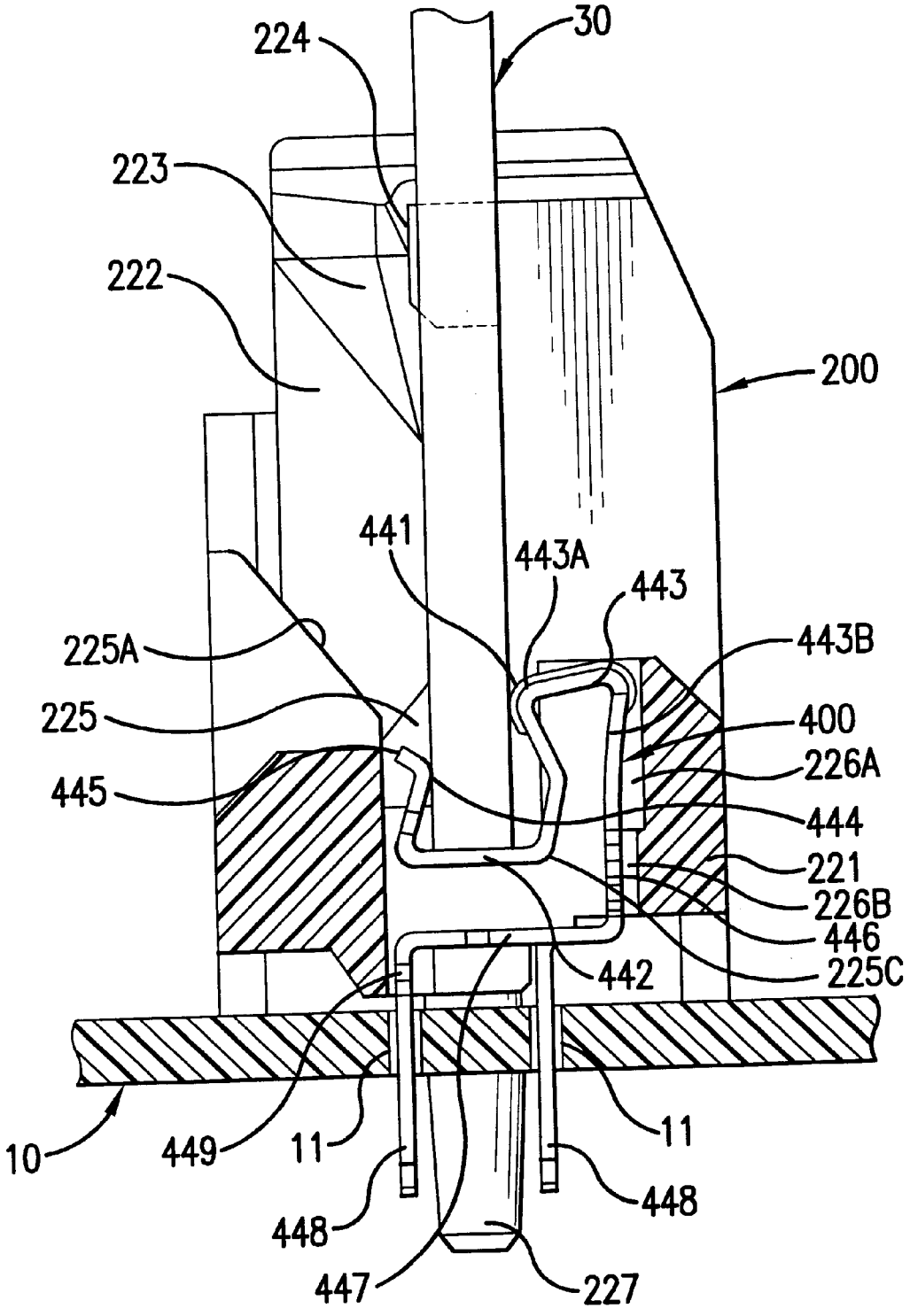
FIG. 8 is a sectional view of the electrical connector of FIG. 1 to which the daughter board has been connected.

As FIGS. 5 and 7 show, a daughter board 30 is inserted into the opening 225 of the insulation housing 221 and rotated rearwardly to connect it in the electrical connector 200. When side edges of the daughter board 30 contact the front faces of the latch sections 223, the daughter board 30 flexes the latch levers 222 outwardly and passes the latch sections 223. When the daughter board 30 passes the latch sections 223, the engaging hole 31 of the daughter board 30 engages the projection 224 while the latch levers 222 snap to the original position so that the latch sections 222 hold the daughter board 30 in place. FIGS. 6 and 8 show such connection conditions.

To remove the daughter board 30 out of the connector, the latch levers 222 are pulled outwardly so that the daughter board 30 is rotated forwardly by the spring force of contact terminals 400 and passes the latch sections 223 for ready to pull it out of the connector.

Figure 2:
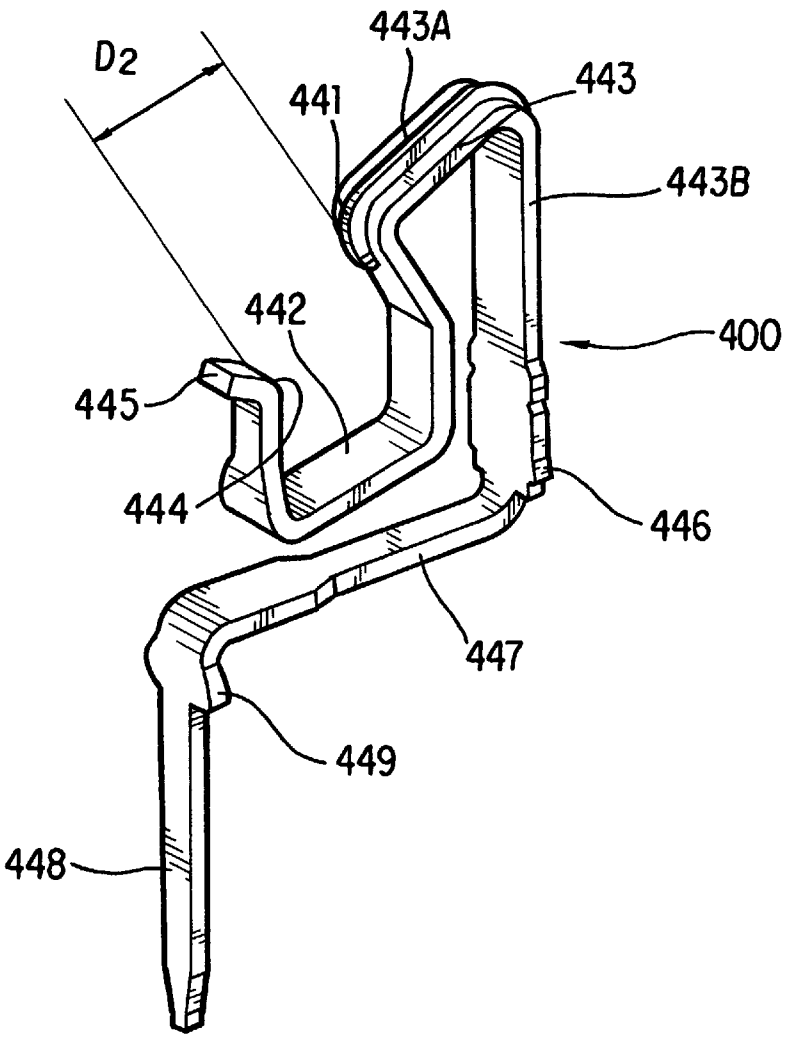
FIG. 2 is a perspective view of a contact terminal of the first type for the electrical connector of FIG. 1.

The structures of the contact terminals 400 and the terminal receiving grooves 226 will be described with reference to FIGS. 2–8. In FIG. 2, a contact terminal 400 of the first type is made by stamping and bending a resilient conductive metal sheet.

The contact terminal 400 has a first retaining section 446 fixed in the terminal receiving groove 226 on the rear wall of the opening 225 and a long extension section 447 extending to the terminal receiving groove on the front wall of the opening 225 (FIG. 1). The long extension sections 447 have a second retaining section 449 fixed in the terminal receiving groove on the front wall. A connection section 448 extends downwardly from the second retaining section 449 for connection to a conductor of the mother board 10.

An reverse U-shaped section 443 extends upwardly from the first retaining section 446 and downwardly to provide an upper contact point 441. A U-shaped section 442 extends to the front wall of the opening and then upwardly along the terminal receiving groove. A free end section 445 extends to the opening 225 and then forwardly to provide a lower contact point 444. A bead 443A is provided from the first retaining section 446 to the upper contact point 441A to provide a large modulus of section, thus minimizing changes under a load and making a floating column 443B of the section between the first retaining section 446 and the upper turning point to keep good contact regardless of a warp of the board. The bead 443 extends to the upper contact point 441 which is used as a contact point for increasing the contact pressure (Hertz stress).

The spring constant of the floating column 443B is controlled by changing the length or width of the floating column 443B. The bead 443A on the upper portion of the floating column controls the amount of deformation of the floating column.

Figure 3:
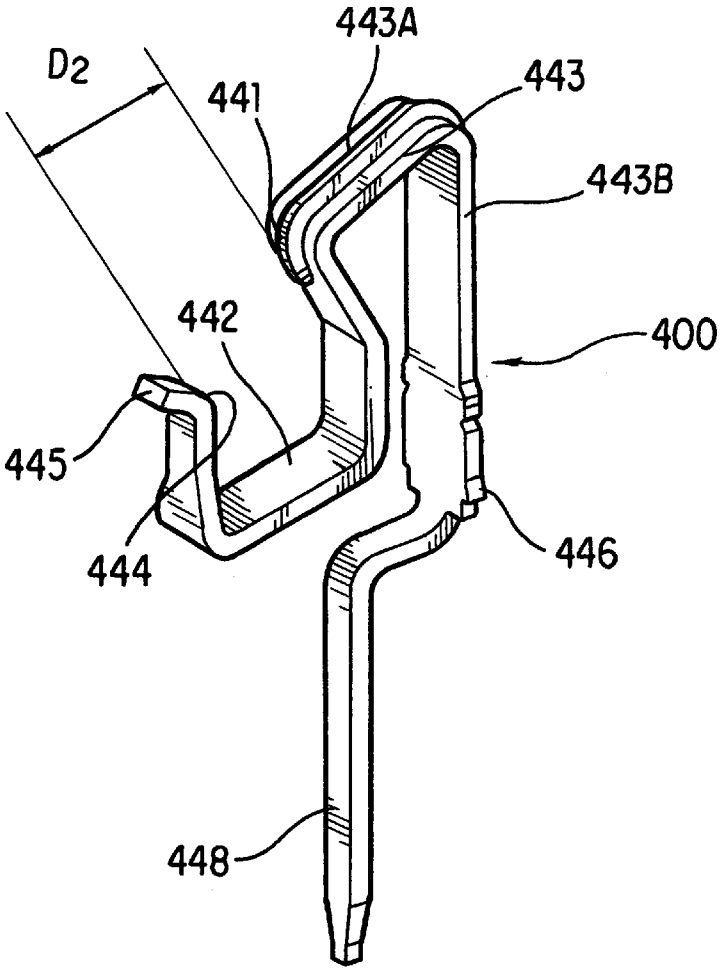
FIG. 3 is a perspective view of a contact terminal of the second type for the electrical connector of FIG. 1.

In FIG. 3, a contact terminal 400 of the second type is shown. This contact terminal is identical with the contact terminal of FIG. 2 except that the connection section 448 extends downwardly from the first retaining section 446 without a long extension section.

Figure 4:
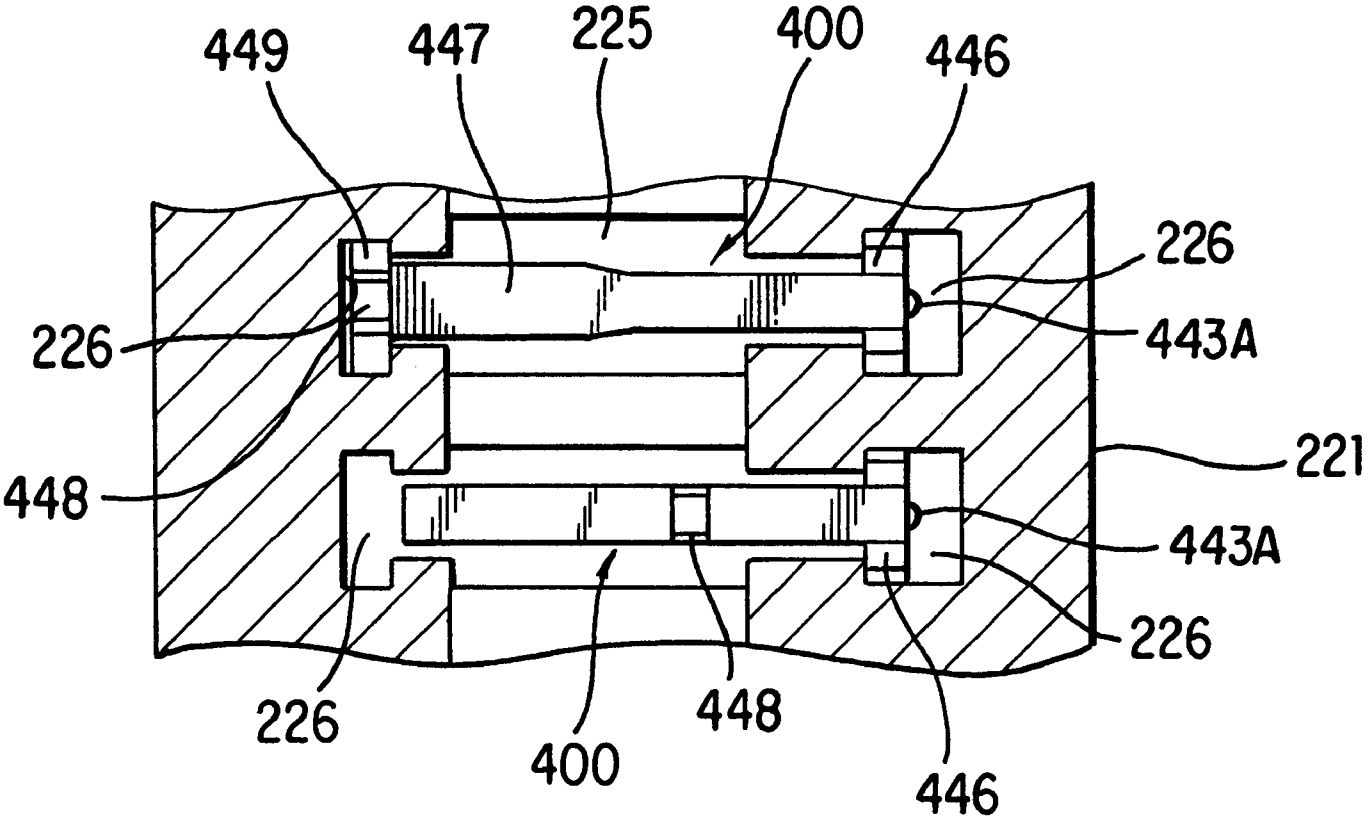
FIG. 4 is a bottom view of part of the electrical connector of FIG. 1.

In FIGS. 4 and 7, the first retaining section 446 of the contact terminal 400 of FIG. 2 is fitted into the terminal receiving grooves 226 on the rear wall while the second retaining section 449 is fitted into the terminal receiving groove 226 on the front wall of the opening. In this way, the contact terminals of FIG. 2 are arranged in every other terminal receiving grooves 226. The first retaining section 446 of the contact terminal 400 of the second type in FIG. 3 is fitted into the terminal receiving groove 226 on the rear wall of the opening. In this way, the contact terminals 400 of FIG. 3 are arranged in every other terminal receiving grooves 226. The connection sections 448 project downwardly from the bottom of the opening 225 in a zigzag arrangement in two rows.

In FIG. 7, the distance D2 between the upper contact point 441 and the lower contact point 444 of the contact terminals 400 is equal to or slightly greater than the thickness D1 of the daughter board 30. The reverse U-shaped section 443 including the upper contact point 441, the U-shaped section 442, and the free end section 445 including the lower contact point 444 constitute a spring section, with the first retaining section 446 as a fulcrum. As FIGS. 7 and 8 show, the upper portion 226A of the terminal receiving groove 226 has a relatively large space to accommodate the floating column 443B of the contact terminal 400. The lower portion 226B of the terminal receiving groove 226 provides a space through which the bead 443A passes when a contact terminal is press fitted.

How to connect the daughter board 30 to the electrical connector 200 will be described with reference to FIGS. 7 and 8. As FIG. 7 shows, the daughter board 30 is inserted obliquely into the opening 225 of the insulation housing 221 along a slanted guide face 225A provided on the upper front portion of the opening 225. Since the distance D2 between the upper contact point 441 and the lower contact point 444 is equal to or slightly greater than the thickness D1 of the daughter board 30, there is no or little resistance to the insertion of the daughter board 30 so that the daughter board 30 is inserted in the opening 225 with zero-insertion force.

When the front or lower end of the daughter board 30 abuts against the slanted face 225B of the bottom wall of the opening 225, the daughter board 30 is rotated towards the rear wall of the opening 225. The daughter board 30 pushes the contact terminals 400 at the upper contact points 441 to flex the spring section consisting of the reverse U-shaped sections 443, the U-shaped sections 442, and the free end sections 445, with the first retaining section as a fulcrum. The daughter board 30 is further rotated against the spring section to passes the latch sections 223 into the latch position as shown in FIG. 8.

FIG. 8 shows a relationship between the contact terminals 400 and the front edge of the daughter board 30 under such latch conditions. The front end face of the daughter board 30 is placed on the flat face 225C of the bottom wall of the opening 225, and the common pads (not shown) on both sides of the front edge are held between the upper and lower contact points 441 and 444.

The operations of the respective components from the angular insertion of the daughter board 30 in FIG. 7 and the connection condition in FIG. 8 will be described in more detail. First of all, the rearward rotation of the daughter board 30 brings the upper contact points 441 toward the rear wall. Then, the floating columns 443B are flexed at the first retaining sections 446 into the enlarged space 226A in the rear wall. The flexure of the floating columns 443B bring the upper contact points 441 to a position which is slightly higher than the prior position of FIG. 7. Simultaneously, the flexure of the floating column 443B brings the upper contact points 441 to a position which is slightly lower than the prior position of FIG. 7 since the reverse U-shaped sections 443 have an acute angle. Accordingly, the upward movement of the upper contact points 441 is partly offset by the downward movement of the upper contact points 441. As a result, the displacement of the upper contact points 441 is restricted to very small upward movement. Such movement of the floating columns 443B and the upper contact points 441 brings the lower contact points 444 to a position in the opening 225 which is much higher than the prior position of FIG. 7.

The contact terminals 400 are made so that the amount of upward movement of the lower contact points 444 is larger than that of the upper contact points 441. Consequently, the difference between the upper and lower contact points 441 and 444 in FIG. 8 is considerably smaller than that of FIG. 7, thus minimizing the moment of rotations or torque upon the daughter board 30 which is caused by the upper and lower contact points 441 and 444. Thus, the warp of the daughter board 30 held by the latch sections 223 is minimized.

Figure 10C:
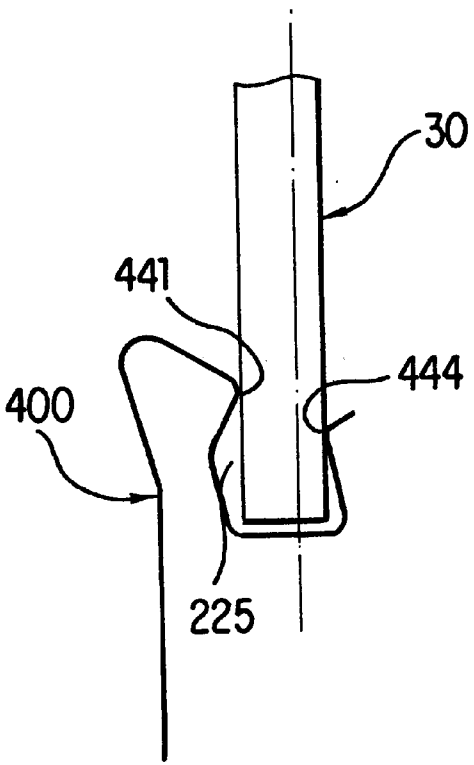
FIGS. 10(A)–(C) are diagrams to show the floating of spring sections of contact terminals for the electrical connector.
Figure 10B:
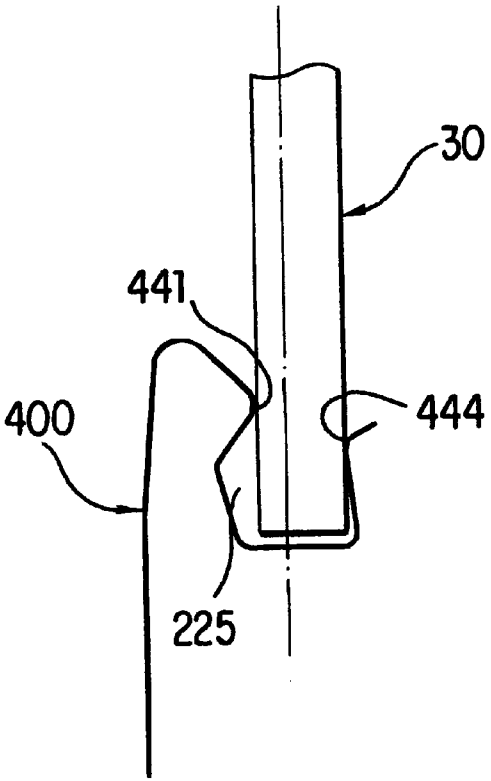
Figure 10A:
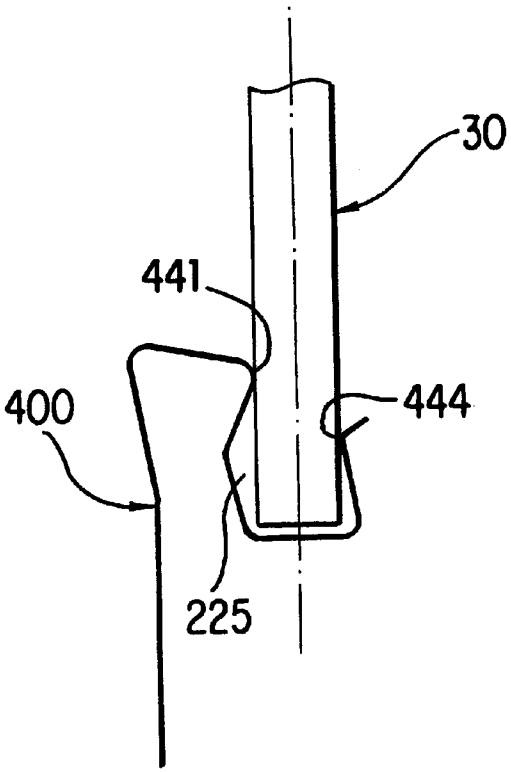

The cooperation between the floating columns 443B and the enlarged space 226A in the rear wall allows the resilient sections consisting of the reversed U-shaped sections 443, the U-shaped sections 442, and the free end sections 445 to flex at the retaining sections 446 so that it is possible to keep constant the contact power of the upper and lower contact points 441 and 444 regardless of the warp of the daughter board 30. As FIGS. 10(A)–(C) show, since the spring sections of the contact terminals 400 including upper and lower contact points 441 and 444 are shifted from the center of the opening 225 depending on the degree of warp of the daughter board 30, the contact power of the upper and lower contact points 441 and 444 are kept constant regardless of the degree of warp of the daughter board 30.

The second retaining sections 449 of every other contact terminals 400 are press fitted to the insulating housing 221 so that the insulating housing 221 is not separated from the mother board 10 when excessive rotary force is applied to the insulating housing 221 upon connection of the daughter board 30 because the retaining sections 449 prevent the contact terminals from being deformed so that the fixing power of the contact terminals 400 is added up to the fixing power of the guide posts 227.

Figure 11:
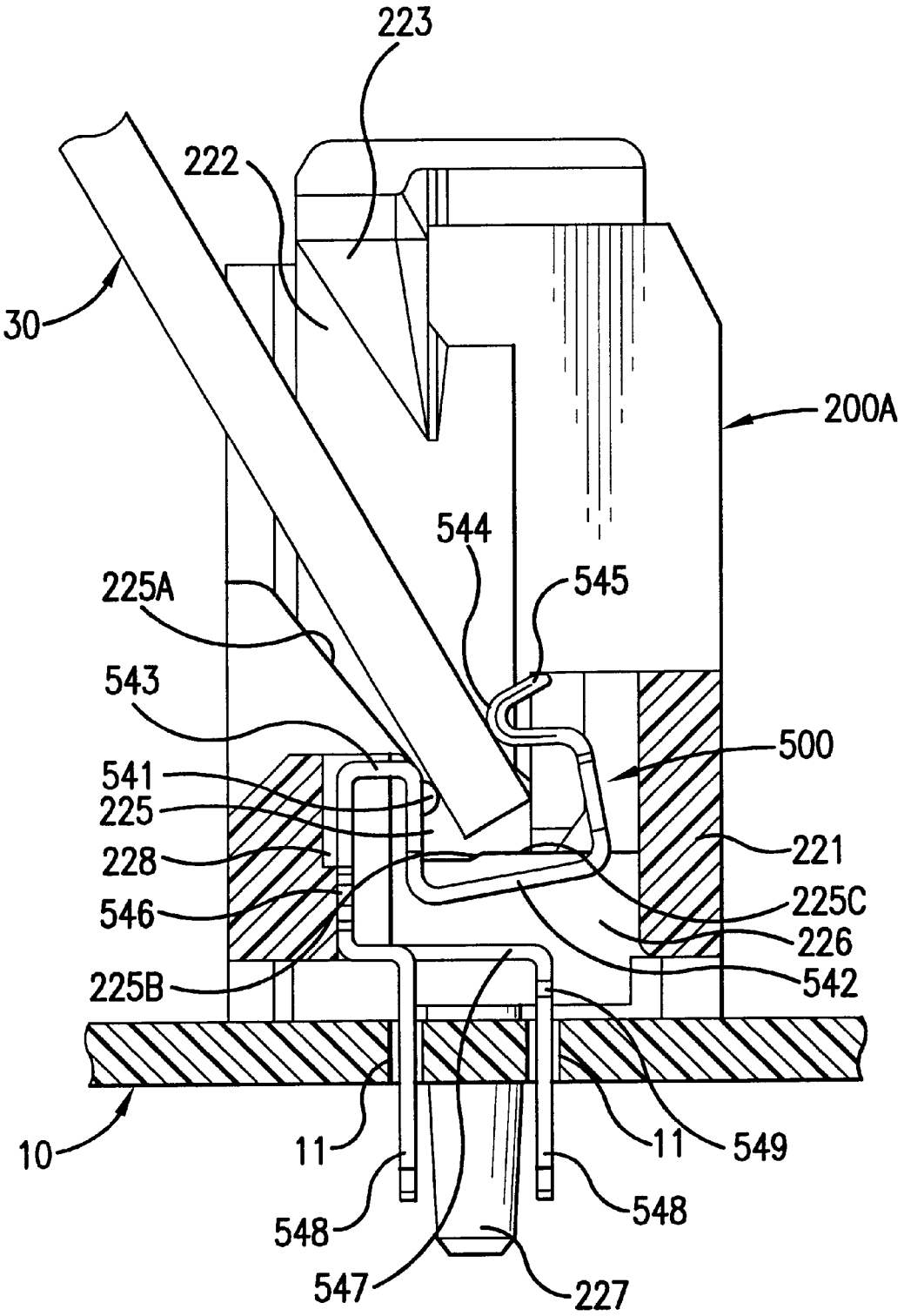
FIG. 11 is a sectional view of an electrical connector according to another embodiment to which a daughter board is being connected.
Figure 12:
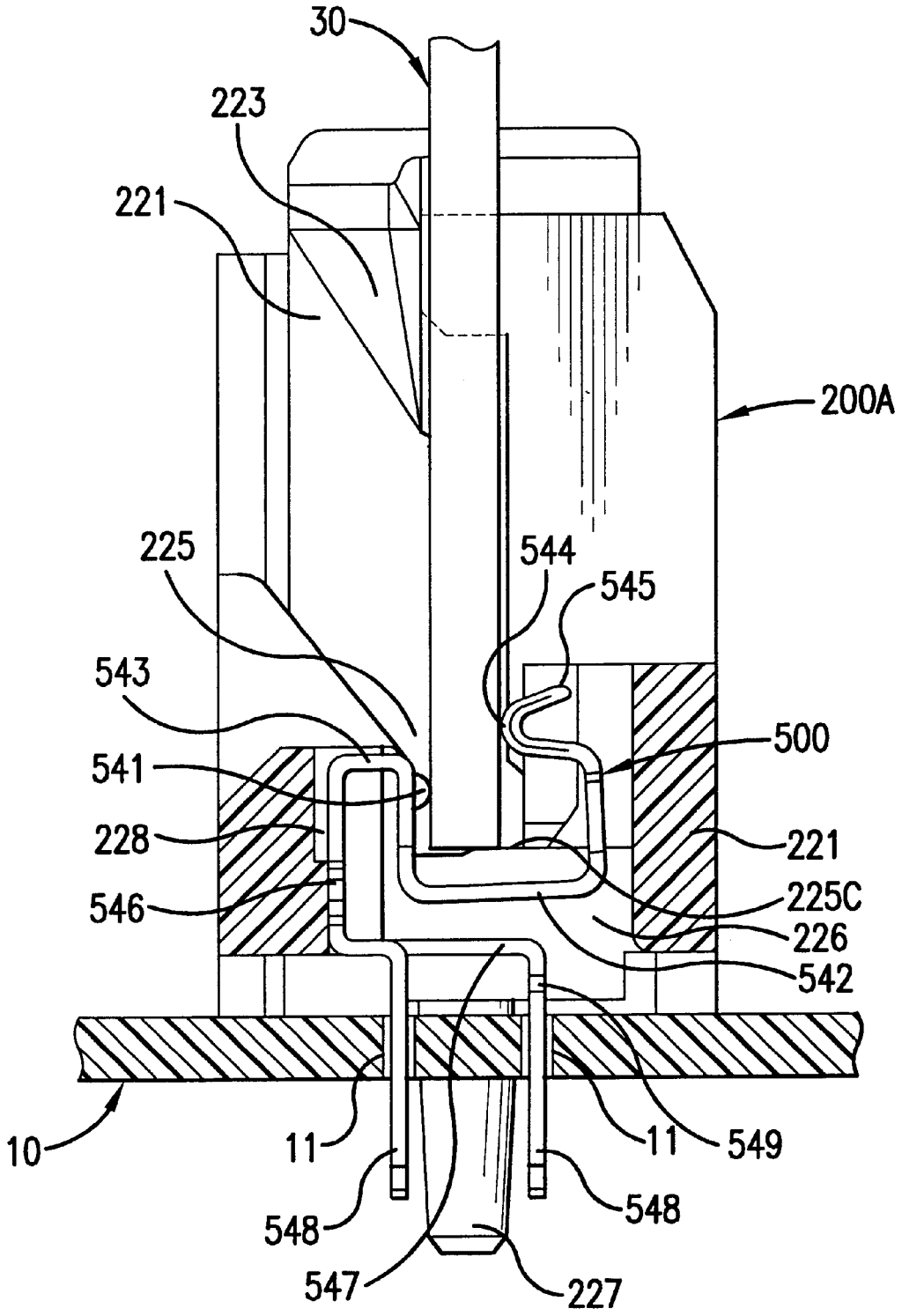
FIG. 12 is a sectional view of the electrical connector of FIG. 11 to which the daughter board has been connected.
Figure 13:
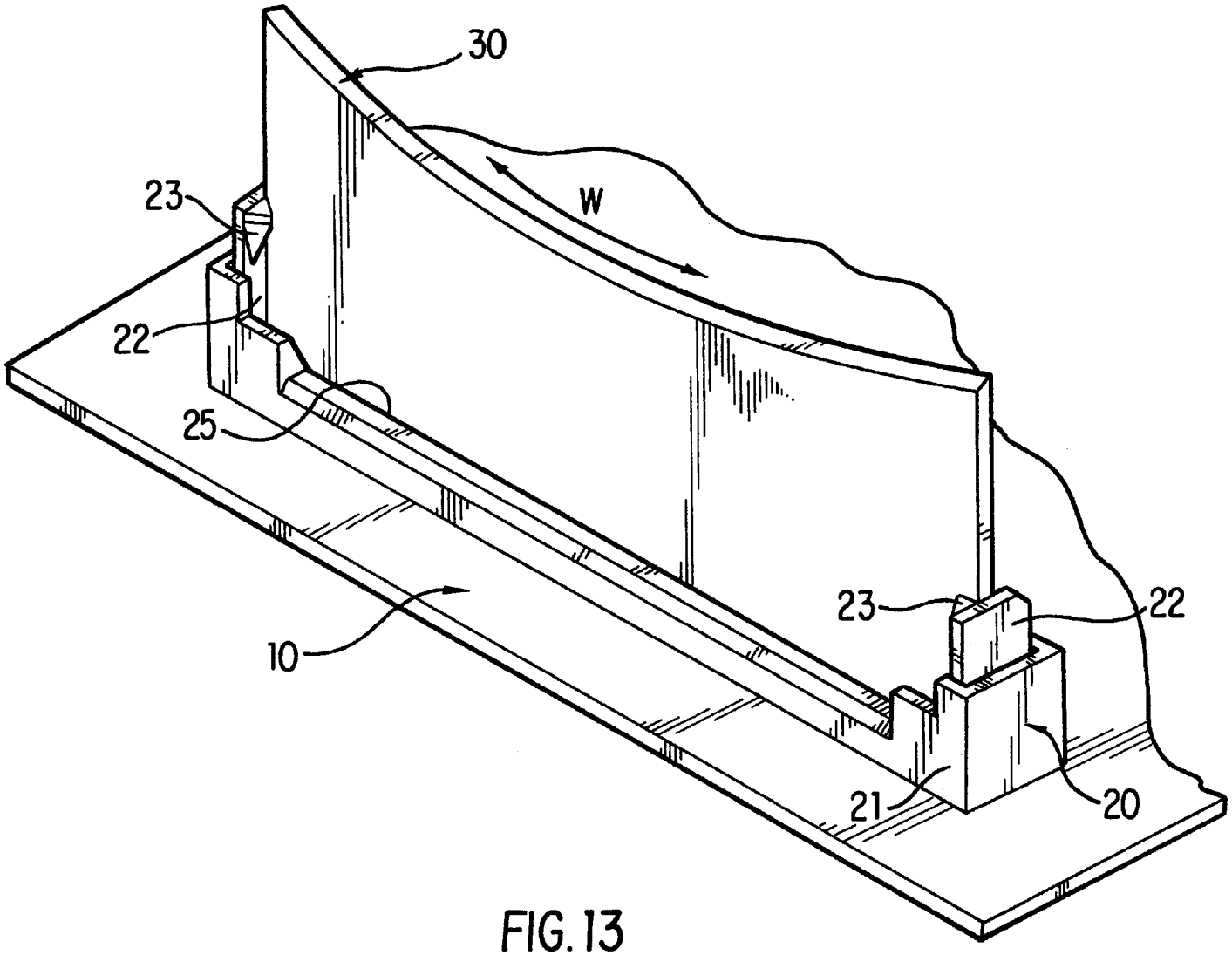
FIG. 13 is a perspective view of a conventional electrical connector to show a problem.
Figure 14:
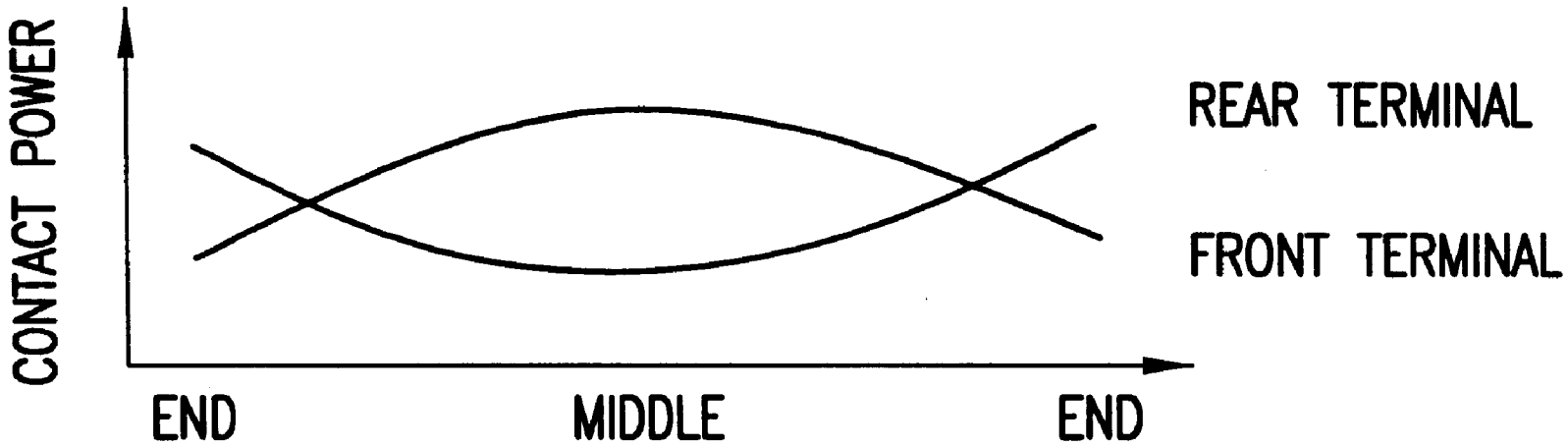
FIG. 14 is a graph to show the uneven contact power of contact terminals for the conventional electric connector.

FIGS. 11 and 12 show an electrical connector according to another embodiment of the invention. The electrical connector 200A is substantially the same as the above embodiment except that the shape of contact terminals 500 are different from the contact terminals 400.

As best shown in FIG. 11, contact terminals 500 of the first type are made by cutting and bending a substantially flat resilient metal sheet. The contact terminals 500 of this type have a first retaining section 546 fixed in terminal receiving grooves 226 in the front wall of the opening 225 and a long extension sections 547 extending in terminal receiving grooves in the bottom wall. A second retaining section 549 is provided on the long extension section 547 and fixed in terminal receiving grooves on the side of the rear wall. A connection section 548 extends downwardly from the second retaining section 549 and is connected to a conductor of the mother board 10.

The contact terminals 500 further have a reverse U-shaped section 543 extending upwardly from the first retaining section 546 and then laterally to the opening to provide a lower contact section 541, a U-shaped section 542 extending from the reverse U-shaped section 543 toward the rear wall and then upwardly in the terminal receiving groove in the rear wall, and a free end section 545 extending from the U-shaped section 542 to the inside of the opening 225 to provide an upper contact section 544.

As shown in FIG. 11, contact terminals 500 of the second type are the same as the above contact terminals except that connection sections 548 extend downwardly from the first retaining sections 546 without the long extension sections.

The contact terminals 500 of these two types are arranged alternately in the terminal receiving grooves 226 of the insulating housing 221. That is, the contact terminal 500 of the first type are arranged in every other terminal receiving grooves 226 such that the first and second retaining sections 546 and 549 are press fitted in the terminal receiving grooves 226 in the front and rear walls, respectively. The contact terminals 500 of the second type are arranged in every other terminal receiving grooves 226 such that the first retaining sections 546 are press fitted in the terminal receiving grooves 226 in the front wall of the insulating housing 221. The connection sections 548 of the contact terminals 500 extend downwardly through the terminal receiving grooves in the bottom wall of the opening so that they are arranged in a zigzag fashion, too.

How to connect the daughter board 30 to the electrical connector 200A will be described with reference to FIGS. 11 and 12. As FIG. 11 shows, the daughter board 30 is inserted obliquely into the opening 225 of the insulation housing 221 along the slanted guide faces 225A provided on opposite sides of the front walls. Since the upper and lower contact points 544 and 541 are spaced equal to or greater than the thickness $D^1$ of the front edge, the resistance against the insertion of the daughter board 30 is almost zero, allowing insertion of the daughter board 30 into the opening 225 with zero-insertion force.

When the front end of the daughter board 30 hits the slant face 225B of the bottom wall of the opening 225, the daughter board 30 is rotated toward the rear wall of the opening 225. As the upper contact points 544 of the contact terminals 500 are pushed rearwardly by the daughter board 30, the spring sections consisting of the reverse U-shaped sections 543, the U-shaped sections 542, and free end sections 545 are flexed at the first fixing section 546. The daughter board 30 is further rotated against the spring sections to pass the latch sections 223 into the latch conditions as shown in FIG. 12.

In FIG. 12, the front or lower end of the daughter board 30 rests on the flat face 225C of the bottom wall of the opening 225, and the common pads (not shown) on the front edge of the daughter board 30 are held between the upper and lower contact points 544 and 541.

The operations of the pads of the daughter board 30 and the upper and lower contact points 544 and 541 from the insertion of the daughter board 30 as shown in FIG. 11 to the connection of the daughter board 30 in FIG. 12 will be described in more detail. As the daughter board 30 is rotated rearwardly and the upper contact points 544 are pushed rearwardly, the spring sections of the reverse U-shaped sections 54f3 and the U-shaped sections 542, and the free end sections 545 are flexed at the first fixing sections 446 to bring the free end sections 545 toward the rear wall. The flexure of the U-shaped sections 542 brings the upper contact points 544 to a position which is more retreated and lower than the prior position of FIG. 11. The flexure of the reverse U-shaped sections brings the lower contact points to a position which is more inside of the opening 225 and lower than the prior position of FIG. 11.

The contact terminals 500 are made so that the amount of downward movement of the upper contact points 544 is greater than that of the lower contact points 541 to thereby make the between the upper and lower contact points 544 and 541 under the connection conditions in FIG. 12 smaller than the pre-connection difference of FIG. 11. In other words, the distance in a direction of the depth of the opening 225 between the upper and lower contact points 544 and 541 under the connection conditions is smaller than the distance before connection. Consequently, the moment of rotations applied to the daughter board 30 by the upper and lower contact points 544 and 541 is minimized.

The cooperation of the enlarged space 228 in the front wall facing the reverse U-shaped sections 543 with the reverse U-shaped sections 543 and the U-shaped sections 542 makes the spring sections consisting of the reverse U-shaped sections 543, the U-shaped sections 542, and the free end sections 545 float with the first retaining sections as a fulcrum so that the contact power of the upper and lower contact points 544 and 541 are kept constant regardless of the degree of warp of the daughter board 30 as described on the above embodiment with respect to FIGS. 10(A)–(C).

In the electrical connector 200A, the second retaining sections 549 are press fitted in the insulating housing 221 so that the insulating housing 221 is not separated from the mother board 10 with the passage of time owing to the bias to rotate forwardly the daughter board 30 under the connection conditions in FIG. 12. Since the second retaining sections 549 are press fitted in the insulation housing 221, the contact terminals 500 are not deformed. Consequently, the fixing power by the contact terminals 500 are added up to the fixing power of the guide posts 227 to fix the insulating housing 221 to the mother board 10.

Figure 9C:
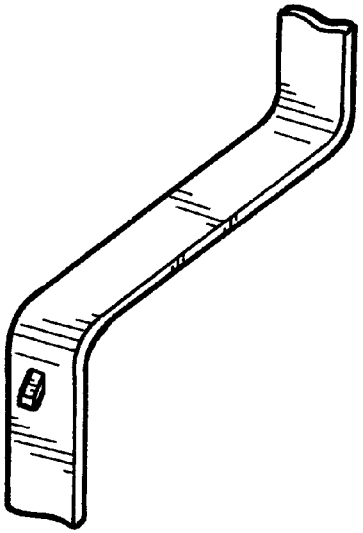
FIGS. 9(A)–(C) are perspective views of the second retaining sections of contact terminals according to various embodiments of the invention.
Figure 9B:
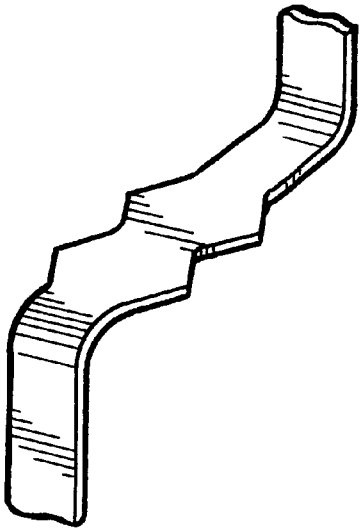
Figure 9A:
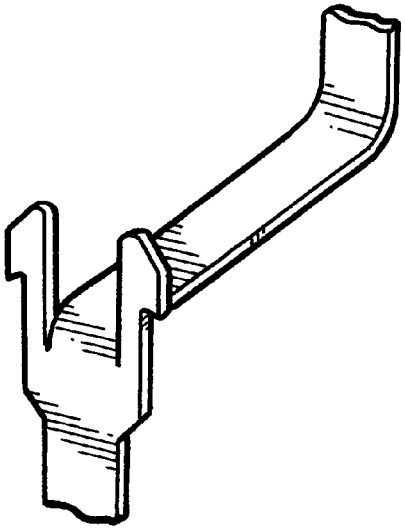

FIGS. 9(A)–(C) show various modifications for the second retaining sections 449 or 549 of the contact terminals 400 or 500. In this way, the shapes of the first and second retaining sections are not limited to those of FIGS. 1–8 and 11–12 but can be those capable of being fixed in the insulating housing. The shape of the terminal receiving grooves may be modified according to the shape of the retaining sections. The first and second retaining sections press fitted in the insulation housing may be molded integrally with the insulation housing.

The daughter board connected to the electrical connector at right angles with the mother connector may be connected to the electrical connector at a given angle, for example, in parallel to the mother board.

Since the distance between the upper and lower contact points of the contact terminals under the connection conditions is minimized, the moment of rotations (to rotate the daughter board to the original position) is minimized, thus minimizing the warp of the daughter board connected without reducing the contact power of the contact terminals and providing reliable contacts.

Since the moment of rotations is small, the warp of the daughter board is minimized, and the contact power of the contact terminals is made even in a direction of arrangement of the contact terminals.

Since the spring sections of the contact terminals float, the contact powers of the upper and lower contact points are kept constant regardless of the degree of warp of the daughter board.

What is claimed is:

1. An electrical connector (200) for connecting a mother board and a daughter board (30) having at least one pad on a leading edge thereof, said electrical connector comprising:

an insulation housing (221) to be mounted on said mother board and having front, rear and bottom walls to define an opening (225) into which said daughter board is inserted at an angle with respect to said mother board and then rotated rearwardly to a connection position;

at least one terminal receiving groove (226) provided in said opening; and an least one contact terminal (400) accommodated in said terminal receiving groove and having a first retaining section (446) fixed on a lower part of said rear wall, a connection section (448) extending from said first retaining section and electrically connected to a conductor of said mother board, a floating column (443B) extending upwardly form said first retaining section, a reverse U-shaped section (443) extending from said floating column to inside of said opening to provide an upper contact portion (441), U-shaped section (442) extending downwardly from said reverse U-shaped section, curving in with an inclined section and turning upwardly, and a free end section (445) extending from said U-shaped section toward said front wall to provided a lower contact portion (444), wherein said reverse U-shaped, U-shaped, and free end sections constituting a spring section;

said reverse U-shaped section has an acute angle;

said upper and lower contact portions of said contact terminal being spaced at a distance equal to or slightly greater than a thickness of said front edge of said daughter board;

said terminal groove being provided with an enlarged space in an upper portion (226A) thereof between said floating column and upper part of said rear wall, thereby allowing said floating column to flex in said enlarged space at the first retaining section; and said spring section being flexed at said first retaining section when said daughter board is rotated rearwardly to said contact position so as to bring said upper and lower contact portions into contact with said pad on said both sides of said leading edge of said daughter board with a predetermined contact force and to reduce a distance between said upper and lower contact portions in a direction of depth of said opening, said electrical connector further comprises a bead (443A) provided on said floating column to control amount of deformation of said floating column.

2. An electrical connector according to claim 1, wherein said upper and lower contact portions of said contact terminal contact said pad on both sides of said front edge of said daughter board when said daughter board is rotated rearwardly to said connection positions.

3. An electrical connector according to claim 1, wherein a spring constant of said floating column is changeable by selecting a contact terminal with different length or width of said floating column before installation of said contact terminal in said terminal receiving groove.

* * * * *